US005190597A

United States Patent [19]

Kobayashi et al.

[11] Patent Number: 5,190,597

[45] Date of Patent: Mar. 2, 1993

[54] PROCESS FOR PRODUCING GRAIN-ORIENTED ELECTRICAL STEEL SHEET HAVING IMPROVED MAGNETIC AND SURFACE FILM PROPERTIES

[75] Inventors: Hisashi Kobayashi; Osamu Tanaka; Hiroyasu Fujii, all of Kitakyushu, Japan

[73] Assignee: Nippon Steel Corporation, Tokyo, Japan

[21] Appl. No.: 788,212

[22] Filed: Nov. 5, 1991

[30] Foreign Application Priority Data

Nov. 7, 1990 [JP] Japan ..... 2-301919

[51] Int. Cl.[5] ..... H01F 1/04

[52] U.S. Cl. ..... 148/111; 148/113

[58] Field of Search ..... 148/111, 113

[56] References Cited

U.S. PATENT DOCUMENTS 4,938,807 7/1990 Takahashi et al. ..... 148/111
5,049,205 9/1991 Takahashi et al. ..... 148/111

FOREIGN PATENT DOCUMENTS 0321695 6/1989 European Pat. Off. ..... 148/111
0339474 11/1989 European Pat. Off. ..... 148/111
40-15644 7/1965 Japan .
47-25250 7/1972 Japan .
52-24116 2/1977 Japan .
59-190324 10/1984 Japan .
61-60896 12/1986 Japan .

*Primary Examiner*—John P. Sheehan
*Attorney, Agent, or Firm*—Kenyon & Kenyon

[57] ABSTRACT

A process for producing a grain-oriented electrical steel sheet having improved magnetic and surface film properties, comprising: using an electrical silicon steel slab containins S in an extremely small amount of 0.012 wt % or less and Mn in a limited range of 0.08 to 0.45 wt %; heating the slab to a relatively low temperature of not higher than 1200° C.; hot-rolling the slab to form a hot-rolled strip; cold-rolling the strip to a thickness of a final product sheet; decarburization-annealing the cold-rolled strip; nitriding the strip while it is travelling; applying an annealing separator to the strip; and final texture-annealing the strip by heating the strip to a first temperature of from 800° to 850° C. in an atmosphere of $(N_2+Ar) \geqq 30$ vol % with 25 vol % or more $N_2$ and the remainder $H_2$ and subsequently heating from the first temperature to above 1200° C. in a conventional atmosphere.

5 Claims, No Drawings

PROCESS FOR PRODUCING GRAIN-ORIENTED ELECTRICAL STEEL SHEET HAVING IMPROVED MAGNETIC AND SURFACE FILM PROPERTIES

BACKGROUND OF THE INVENTION

1. Field of the Invention

The present invention relates to a process for producing a grain-oriented electrical steel sheet having improved magnetic and surface film properties.

2. Description of the Related Art

The grain-oriented electrical steel sheet is used as a core material of transformers, generation, and other electrical equipment, and therefore, is required to have not only good magnetization and watt-loss properties but also a good surface film.

A grain-oriented electrical steel sheet is obtained by utilizing a secondary recrystallization phenomenon in which crystal grains having a {110} plane parallel to the rolled surface and a <001> axis parallel to the rolling direction are developed. The secondary recrystallization occurs in a final texture annealing step. To ensure a complete manifestation of the secondary recrystallization, an inhibitor such as AlN, MnS, MnSe, or other fine precipitates must be present in steel to suppress growth of primary-recrystallized grains until the steel is heated to a temperature region in which the secondary recrystallization manifests during the final texture annealing. To ensure a complete dissolution of an inhibitor forming element such as Al, Mn, S, Se, and N in steel, the electrical steel slab is heated to a high temperature of 1350° to 1400° C.

The inhibitor forming elements completely dissolved in the electrical steel slab are precipitated in the form of a fine particle of AlN, MnS, MnSe, etc. by annealing a hot-rolled strip or by intermediate annealing prior to a final stage of cold rolling.

In this process, an electrical steel slab is heated to a high temperature as mentioned above, which causes a formation of a great amount of molten scale or slag, and in turn, requires frequent mending of a heating furnace, raises maintenance cost, reduces the availability factor of equipment, and raises fuel cost per unit weight of product.

To eliminate these drawbacks, studies have been carried out to develop a process for producing a grain-oriented electrical steel sheet in which the heating of an electrical steel slab is conducted at a lower temperature.

Japanese Unexamined Patent Publication (Kokai) No. 52-24116, for example, discloses a process in which an electrical steel slab contains Zr, Ti, B, Nb, Ta, V, Cr, Mo and other nitride forming elements, besides Al, so that the slab heating can be carried out at a temperature of from 1100° to 1260° C.

Japanese Unexamined Patent Publication (Kokai) No. 59-190324 discloses a process in which an electrical steel slab contains carbon in an amount as low as 0.01% or less and selectively contains S, Se, Al, and B and the surface of a steel is repeatedly heated or pulse-annealed in a primary recrystallization annealing after cold rolling, so that the slab heating can be carried out at a temperature of 1300° C. or lower.

Japanese Examined Patent Publication (Kokoku) No. 61-60896 discloses a process in which an electrical steel slab contains 0.08 to 0.45% manganese and 0.007% or less sulfur, i.e., has a small value of the product [Mn][S], and also contains Al, P, and N, so that the slab heating can be carried out at a temperature of 1280° C. or lower.

Based on the process of Japanese Examined Patent Publication (Kokoku) No. 61-60896, the present inventors and others proposed an improved process in Japanese Patent Application No. 1-91956, i.e., a process for producing a grain-oriented electrical steel sheet having improved magnetic and surface film properties, in which a final cold-rolled strip is nitrided while it is travelling, and thereby, an inhibitor is introduced into the strip.

The above-mentioned conventional processes, however, has a drawback in that a glass film of a final product sheet sometimes contains a defect called "pepper-and-salt" or "bare spots".

SUMMARY OF THE INVENTION

The object of the present invention is to provide a process for producing a grain-oriented electrical steel sheet having improved magnetic and surface film properties, ensuring high productivity and stable manufacture, in which the slab heating is carried out at a reduced temperature of 1200° C. or lower to reduce energy consumption for the slab heating and solve those problems caused by the high temperature slab heating, including high maintenance costs, low availability factor of equipment, and low productivity.

To achieve the above object according to the present invention, there is provided a process for producing a grain-oriented electrical steel sheet having improved magnetic and surface film properties, the process comprising the steps of:

heating to a temperature of 1200° C. or less an electrical steel slab consisting, in wt %, of 0.025 to 0075 carbon, 2.5 to 4.5 silicon, 0.012 or less sulfur, 0.010 to 0.060 acid-soluble aluminum, 0.010 or less nitrogen, 0.08 to 0.45 manganese, and the balance consisting of iron and unavoidable impurities;

hot rolling the slab to form a hot-rolled strip;

cold rolling the hot-rolled strip to form a cold-rolled strip having a thickness of a final product through a single cold rolling stage or two or more stages of cold rolling, between which stages intermediate annealing is conducted;

decarburization-annealing the cold-rolled strip, accompanied by a formation of a silica substrate on the strip;

nitriding the decarburization-annealed strip while it is travelling;

applying an annealing separator to the nitrided strip; and final texture-annealing the strip by heating the strip to a first temperature of from 800° to 850° C. in an atmosphere having a composition of 30 vol % or more ($N_2$+Ar) with 25 vol % or more $N_2$ and the remainder $H_2$, subsequently heating the slab from the first temperature to a second temperature of about 1200° C. in an atmosphere having a composition of 25 to 35 vol % $N_2$ and 75 to 65 vol % $H_2$, and subsequently heating the slab from the second temperature and above in an atmosphere having a composition of 100 vol % $H_2$.

DESCRIPTION OF THE PREFERRED EMBODIMENTS

After numerous studies on a process for producing a grain-oriented electrical steel sheet having improved magnetic and surface film properties by using a reduced slab heating temperature of 1200° C. or lower, the present inventors found that, on a basis of a process disclosed by the present inventors and others in Japanese Patent Application No. 1-91956, a glass film having good adhesion and appearance without a defect such as "pepper-and-salt" is obtained by controlling an atmosphere of a final texture annealing, i.e., by heating the strip to a first temperature of from 800° to 850° C. in an atmosphere having a composition of 30 vol % or more (Nhd 2+Ar) with 25 vol % or more $N_2$ and the remainder $H_2$, subsequently heating the slab from the first temperature to a second temperature of about 1200° C. in an atmosphere having a composition of 25 to 35 vol % $N_2$ and 75 to 65 vol % $H_2$, and subsequently heating the slab from the second temperature and above in an atmosphere having a composition of 100 vol % $H_2$. An electrical steel slab used as the starting material in the present inventive process must have a chemical composition within the specified range for the following reasons.

The carbon content of the steel slab must be within the range of from 0.025 to 0.075 wt %. When the carbon content is less than 0.025 wt %, a secondary recrystallization is unstable, and even if the secondary recrystallization is completed, a product sheet has a magnetic flux density as low as 1.80 Tesla in terms of the $B_{10}$ value. When the carbon content is more than 0.075 wt %, a decarburization-annealing must be carried out for a long time and the productivity is significantly reduced.

The silicon content must be 2.5 wt % or more, to obtain a highest grade of watt-loss value, specifically a watt-loss value of 1.05 W/kg or less in terms of the $W_{17/50}$ value for a sheet thickness of 0.30 mm. From this point of view, the silicon content is preferably 3.2 wt % or more. When the silicon content is more than 4.5 wt %, a stable operation of cold rolling cannot be ensured because cracking and breakage of the steel sheet frequently occur during cold rolling.

One of the characteristics of the chemical composition of the present inventive steel slab is that the sulfur content is 0.012 wt % or less, preferably 0.0070 wt % or less. Conventionally, sulfur is essential to form MnS, which is one of the precipitates required to induce secondary recrystallization, as stated in Japanese Examined Patent Publication (Kokoku) Nos. 40-15644 and 47-25250. In these conventional technologies, sulfur must be present in steel in an optimum range of amount for manifesting the particular effect thereof, as specified by an amount such that the MnS precipitate can be decomposed and dissolved in steel during heating of a slab. However, it was not conventionally recognized at all that the presence of sulfur in steel adversely affects the secondary recrystallization. The present inventors have found that sulfur causes an incomplete secondary recrystallization in a process of producing a grain-oriented electrical steel sheet, in which (Al,Si)N is used as the necessary precipitate for secondary recrystallization and a slab containing a large amount of silicon is heated at a relatively lower temperature and then hot-rolled. When the silicon content of an electrical steel slab is 4.5 wt % or less, the sulfur content must be 0.012 wt % or less and is preferably 0.0070 wt % or less, to thoroughly prevent the occurrence of an incomplete secondary recrystallization.

The present invention uses (Al,Si)N as the precipitate necessary for secondary recrystallization. To ensure the formation of AlN in a minimum required amount, Al must be contained in steel in an amount of 0.010 wt % or more in terms of the amount of acid soluble aluminum and N must be contained in steel in an amount of 0.0030 wt % or more.

Nevertheless, when the content of acid soluble Al is more than 0.060 wt %, AlN is present in an inappropriate form in a hot-rolled strip and the secondary recrystallization becomes unstable. When the N content is more than 0.010 wt %, a swelling or "blister" occurs in the steel sheet surface, and also, the grain size of primary-recrystallized grains cannot be controlled.

Another characteristic of the chemical composition of the present inventive steel slab is the Mn content. To obtain a product having a highest grade of watt-loss value, the present invention uses a Si content of 2.5 wt % or more. The extremely low level of the S content according to the present invention eliminates the problem of incomplete secondary recrystallization which would otherwise occur when a slab having such a high Si content is subjected to a low temperature slab heating followed by a hot rolling. Thus, the absence of the effect of MnS on the secondary recrystallization yields a relatively low magnetic flux density of a product sheet. Therefore, the present invention controls the Mn content within a proper range to ensure a magnetic flux density of 1.89 Tesla or higher. The more the Mn content, the more unstable the secondary recrystallization, and the less the Mn content, the higher the $B_{10}$ value. An excessive amount of Mn does not bring a further improvement but only raises the production costs. For these reasons, Mn must be present in an amount of from 0.08 to 0.45 wt % to obtain a product sheet having a magnetic flux density of 1.89 Tesla or higher, ensure a stable secondary recrystallization, and suppress cracking of the strip being cold-rolled.

It should be noted that a steel slab according to the present invention may acceptably contain a minute amount of Cu, Sn, P, Ti, and B.

An electrical steel slab of the present invention is prepared by melting a steel in a melting furnace such as a converter, an electric furnace, etc., subjecting the molten steel to a vacuum degassing treatment, if necessary, and then continuous-casting or ingot casting followed by blooming.

The electrical steel slab thus prepared is then subjected to a slab heating prior to hot rolling. In the process according to the present invention, the slab heating is effected at a relatively low temperature of 1200° C. or lower not only to reduce energy consumption for the heating but also to incompletely dissolve AlN in steel, i.e., AlN is in the state of an incomplete solid solution in steel. With this low temperature slab heating, MnS having a higher dissolution temperature is, of course, incompletely dissolved in steel.

After heating, the slab is hot-rolled to form a hot-rolled strip, which is directly, or after a necessary annealing, cold-rolled to a cold-rolled strip having a thickness of a final product sheet through a single stage of cold rolling or two or more stages of cold rolling, between which stages an intermediate annealing is carried out.

According to the present invention, the electrical steel slab is heated at a relatively low temperature of 1200° C. or lower, with the result that Al, N, S, etc., are incompletely dissolved in steel. Under this condition the slab does not contain the precipitates such as (Al,Si)N, MnS, etc. serving as an inhibitor for inducing the secondary recrystallization during final texture annealing. To provide an inhibitor such as (Al,Si)N, it is necessary to introduce N into steel prior to manifestation of the secondary recrystallization. According to the present invention, after decarburization-annealing in an atmosphere of a gas mixture of $H_2$ and $N_2$ in a usual manner and prior to application of an annealing separator, a steel strip is nitrided in a gas atmosphere containing ammonia to provide a nitrogen content of steel of 150 ppm or more.

The steel strip is then applied with an annealing separator such as a magnesia powder with a minute amount of additives, and coiled to form a strip coil.

The present inventors carried out an experiment, in which an annealing separator is applied on sample plates, which are then laminated and annealed in an experimental annealing furnace by using different atmospheres, and found that the annealing atmosphere used in a temperature region up to a temperature of from 800° to 850° C. has a close relationship with magnetic and surface film properties of a final texture-annealed steel sheet.

The present inventors also found that, in an actual final texture annealing of a tight coil, a dry atmosphere having a dew point of −10° C. or lower is used, and therefore, the usual atmosphere of 25 vol % $N_2$+75 vol % $H_2$ cannot stably yield a good surface film of a final texture-annealed sheet, i.e., even a minute fluctuation of the annealing condition could cause bare spots to occur in a glass film. To eliminate this defect, the present inventors and others proposed to use an annealing atmosphere having a higher dew point with the gas composition unchanged, as disclosed in Japanese Patent Application No. 1-91956. This process, however, requires not only additional humidifier equipment but also a uniform water supply over the entire strip coil, which raises the production cost and is technologically difficult.

After numerous studies under the provision of the use of a dry atmosphere, the present inventors found that a glass film having a good adhesion and appearance, containing no defects such as "pepper-and-salt" or "bare spots", and ensuring a good magnetic property is obtained when a final texture annealing is carried out by heating a steel strip to a first temperature of from 800° to 850° C. in a first atmosphere having a composition of 30 vol % or more ($N_2$+Ar) with 25 vol % or more $N_2$ and the remainder $H_2$, subsequently heating the slab from the first temperature to a second temperature of about 1200° C. in a second atmosphere having a composition of 25 to 35 vol % $N_2$ and 75 to 65 vol % $H_2$, and subsequently heating the slab from the second temperature and above in a third atmosphere having a composition of 100 vol % $H_2$. The second and third atmosphere compositions used in the latter two temperature regions are those which have been conventionally used.

In the first temperature region, i.e., until the strip is heated to a temperature of from 800° to 850° C., the annealing atmosphere must have a composition of 30 vol % or more ($N_2$+Ar) with 25 vol % or more $N_2$ and the remainder $H_2$, in which either the $N_2$ content is increased or the Ar is added with respect to the conventional atmosphere to reduce the $H_2$ partial pressure by using a reduced $H_2$ content of 70 vol % or less.

The present inventors investigated the effect of a reduced $H_2$ partial pressure on the glass film of a grain-oriented electrical steel sheet and found that a very thin layer of amorphous silica is formed on the outermost surface of a steel strip in the initial stage of the glass film formation in a temperature region of from 700° to 800° C. and suppresses a reaction between an annealing separator and a substrate silica formed during decarburization annealing, and thereby, the reaction progresses at a stretch in the temperature region of from 900° to 1000° C. in which a reaction between magnesia and silica begins. On the other hand, when the $H_2$ partial pressure is high, a crystalline silica containing Mn, Cr, etc., instead of amorphous silica, is formed and grows on the outermost surface of a steel strip and suppresses the reaction between the substrate silica and the magnesia powder to impede the formation of a glass film. It is not clarified at present what causes the difference between the amorphous silica and the crystalline silica. The $N_2$ gas has a relationship with the formation of inhibitors and need be present in an amount of 25 vol % or more. When the $N_2$ gas content is less than 25 vol %, an incomplete secondary recrystallization may occur in relatively thin sheets. To reduce the production cost, Ar may be entirely substituted by $N_2$. The $H_2$ partial pressure may be zero.

In the second temperature region above the first temperature of from 800° to 850° C., the reaction between a magnesia powder and a substrate silica begins. In this temperature region, the annealing atmosphere must have a composition of 25 to 35 vol % $N_2$+75 to 65 vol % $H_2$ as is used in the conventional process, because an $N_2$ gas content exceeding this range suppresses the reaction between a magnesia powder and the substrate silica, and in turn, the formation of a glass film. An $N_2$ content higher than the above range is considered to adversely affect the activation of the interface between the magnesia and the substrate silica.

In the third temperature range above 1200° C., the annealing atmosphere need be 100 vol % $H_2$ as used in the conventional process, to ensure desulfurization and denitrification of the strip.

As described above, the present invention controls the annealing atmosphere in the temperature region up to a temperature of from 800° to 850° C., and thereby, provides a grain-oriented electrical steel sheet having good glass film property and magnetic property, without encountering problems in the conventional process using a humidified annealing atmosphere.

EXAMPLES

Example 1

An electrical steel slab consisting of 0.050 wt % C, 3.2 wt % Si, 0.07 wt % Mn, 0.025 wt % acid soluble Al, 0.007 wt % S, and the balance consisting of Fe and unavoidable impurities was heated to 1200° C., then hot-rolled to a 2.3 mm thick hot-rolled strip. The strip was then annealed at 1120° C. for 3 min and cold-rolled to a final thickness of 0.30 mm. The cold-rolled strip was decarburization-annealed at 850° C. for 2 min in an atmosphere of 25 vol % $N_2$+75 vol % $H_2$ having a dew point of 60° C. and nitrided in an atmosphere of a gas containing ammonia at 750° C. for 30 sec to introduce 180 ppm nitrogen into the steel strip. After cooling, the strip was applied with an annealing separator mainly composed of MgO in the form of a water slurry by means of a roller coater; dried by heating in a dryer furnace to 150° C. in terms of the strip temperature, and then coiled to form a strip coil.

The strip coil was placed in a final texture annealing furnace, in which it was final texture-annealed by heating to 800° C. in an atmosphere of 50 vol % $N_2$+50 vol % $H_2$, from 800° to 1200° C. in an atmosphere of 25 vol % $N_2$+75 vol % $H_2$, and above 1200° C. in an atmosphere of 100 vol % $H_2$.

For comparison, another strip coil was final texture-annealed in the conventional manner, i.e., by heating to 1200° C. in an atmosphere of 25 vol % $N_2$ +75 vol % $H_2$ and above 1200° C. in an atmosphere of 100 vol % $H_2$.

Table 1 summarizes the glass film property and the magnetic property of these products.

TABLE 1

| | $B_{10}$ (Tesla) | $W_{17/50}$ (w/kg) | Glass film defect (*) |
|---|---|---|---|
| Invention | 1.93 | 0.96 | none |
| Conventional | 1.90 | 1.04 | some oberved |

(*) Note:
Defect in the form of a shining spot with metallic luster, at which a forsterite glass film is not present.

Table 1 shows that the present invention provides an improved surface film and magnetic properties in comparison with the conventional process.

EXAMPLE 2

An electrical steel slab consisting of 0.06 wt % C, 3.2 wt % Si, 0.1 wt % Mn, 0.03 wt % acid soluble Al, 0.008 wt % S, and the balance consisting of Fe and unavoidable impurities was heated to 1200° C., then hot-rolled to a 2.3 mm thick hot-rolled strip. The strip was then annealed at 1150° C. for 3 min and cold-rolled to a final thickness of 0.23 mm. The cold-rolled strip was decarburization-annealed at 830° C. for 3 min in an atmosphere of 25 vol % $N_2$+75 vol % $H_2$ having a dew point of 55° C. and nitrided in an atmosphere of a gas containing ammonia at 800° C. for 15 sec to introduce 200 ppm nitrogen into the steel strip. After cooling, the strip was applied with an annealing separator mainly composed of MgO in the form of a water slurry by means of a roller coater, dried by heating in a dryer furnace to 150° C. in terms of the strip temperature, and then coiled to form a strip coil.

The strip coil was placed in a final texture annealing furnace, in which it was final texture-annealed by heating to 850° C. in an atmosphere of 75 vol % $N_2$+25 vol % Ar, from 850° to 1200° C. in an atmosphere of 25 vol % $N_2$+75 vol % $H_2$, and above 1200° C. in an atmosphere of 100 vol % $H_2$.

For comparison, another strip coil was final texture-annealed in the conventional manner, i.e., by heating to 1200° C. in an atmosphere of 25 vol % $N_2$+75 vol % $H_2$ and above 1200° C. in an atmosphere of 100 vol % $H_2$.

Table 2 summarizes the glass film property and the magnetic property of these products.

TABLE 2

| | $B_{10}$ (Tesla) | $W_{17/50}$ (w/kg) | Glass film properties: Adhesion (*1) | Tension | Defect (*2) |
|---|---|---|---|---|---|
| Invention | 1.93 | 0.96 | 5 mm | 810 kg/mm$^2$ | none |
| Conventional | 1.90 | 1.04 | 20 mm | 500 kg/mm$^2$ | some observed |

Note
(*1): Minimum diameter at which a glass film does not exfoliate in a 180° bending test.
(*2): Defect in the form of a shining spot with metallic luster, at which a forsterite glass film is not present.

Table 2 shows that the present invention provides an extremely improved surface film and magnetic properties in comparison with the conventional process.

The present invention provides an epoch-making process greatly contributing to the manufacture of grain-oriented electrical steel sheets, by improving both the glass film property and the magnetic property by using a controlled atmosphere in the temperature region up to a temperature of from 800° to 850° C. in the final texture annealing step.

We claim:

1. A process for producing a grain-oriented electrical steel sheet having improved magnetic and surface film properties, said process comprising the steps of:

heating to a temperature of 1200° C. or less an electrical steel slab consisting, in wt %, of 0.025 to 0.075 carbon, 2.5 to 4.5 silicon, 0.012 or less sulfur, 0.010 to 0.060 acid-soluble aluminum, 0.010 or less nitrogen, 0.08 to 0.45 manganese, and the balance consisting of iron and unavoidable impurities;

hot rolling said slab to form a hot-rolled strip;

cold rolling said hot-rolled strip to form a cold-rolled strip having a thickness of a final product through a single cold rolling stage or two or more stages of cold rolling, between which stages an intermediate annealing is conducted;

decarburization-annealing said cold-rolled strip;

nitriding said decarburization-annealed strip while it is travelling;

applying an annealing separator to said nitrided strip; and final texture-annealing said strip by heating the strip to a first temperature of from 800° to 850° C. in an atmosphere having a composition of 30 vol % or more ($N_2$+Ar) with 25 vol % or more $N_2$ and the remainder $H_2$, subsequently heating the slab from said first temperature to a second temperature of about 1200° C. in an atmosphere having a composition of 25 to 35 vol % $N_2$ and 75 to 65 vol % $H_2$, and subsequently heating the slab from and to above said second temperature in an atmosphere having a composition of 100 vol % $H_2$.

2. A process according to claim 1, wherein said nitriding of said decarburization-annealed strip is carried out in a gas containing ammonia until the nitrogen content of said strip becomes 150 ppm or more.

3. A process according to claim 1, wherein said electrical steel slab contains 3.2 wt % or more Si.

4. A process according to claim 1, wherein said electrical steel slab contains 0.0070 wt % or less S.

5. A process for producing a grain-oriented electrical steel sheet having improved magnetic and surface film properties, said process comprising the steps of:

heating an electrical steel slab consisting, in wt %, of 0.025 to 0.075 carbon, 2.5 to 4.5 silicon, 0.012 or less sulfur, 0.010 to 0.060 acid-soluble aluminum, 0.010 or less nitrogen, 0.08 to 0.45 manganese, and the balance consisting of iron and unavoidable impurities, to a temperature of 1200° C. or less so that an inhibitor precipitate is not completely dissolved in said steel;

hot rolling said slab to form a hot-rolled strip;

cold rolling said hot-rolled strip to form a cold-rolled strip having a thickness of a final product through a single cold rolling stage or two or more stages of cold rolling, between which stages an intermediate annealing is conducted;

decarburization-annealing said cold-rolled rolled strip, with an accompanied formation of a silica layer on said strip;

nitriding said decarburization-annealed strip while it is travelling, to provide a nitrogen content of said steel in a sufficient amount to form an inhibitor precipitate in said steel;

applying an annealing separator to said nitrided strip; and final texture-annealing said strip by heating said strip to a first temperature of from 800° to 850° C. in an atmosphere having a composition of 30 vol % or more ($N_2$+Ar) with 25 vol % or more $N_2$ and the remainder $H_2$ so that a thin layer of amorphous silica is formed as an outermost surface layer on said strip to suppress a reaction between said annealing separator and said silica layer until said strip is heated to above said first temperature, subsequently heating the slab from said first temperature to a second temperature of about 1200° C. in an atmosphere having a composition of 25 to 35 vol % $N_2$ and 75 to 65 vol % $H_2$ so that said reaction between said annealing separator and said silica layer progresses, and subsequently heating the slab from and to above said second temperature in an atmosphere having a composition of 100 vol % $H_2$ so that desulfurization and denitrification of said strip are effected.

* * * * *